United States Patent [19]

Albano

[11] 4,153,363

[45] May 8, 1979

[54] BATCH DEVELOPING

[75] Inventor: Carlo J. Albano, Burlington, Mass.

[73] Assignee: Cordell Engineering, Inc., Everett, Mass.

[21] Appl. No.: 849,224

[22] Filed: Nov. 7, 1977

[51] Int. Cl.[2] ..... G03D 3/10

[52] U.S. Cl. ..... 354/299; 354/322; 134/57 R

[58] Field of Search ..... 354/299, 298, 312, 316, 354/319, 320, 321, 322, 324; 134/57 R, 58, 83

[56] References Cited

U.S. PATENT DOCUMENTS

| | | | |
|---|---|---|---|
| 1,967,889 | 7/1934 | Kitroser | 354/299 |
| 3,412,667 | 11/1968 | Hunt | 118/425 |
| 3,559,553 | 10/1967 | Buechner | 134/58 |
| 3,641,906 | 2/1972 | Orr | 134/57 |
| 3,772,980 | 11/1973 | Orr | 134/83 |
| 3,869,313 | 3/1975 | Jones et al. | 134/58 R |
| 3,901,253 | 8/1975 | Collins et al. | 134/57 R |
| 4,011,573 | 3/1977 | Braico | 354/329 |

*Primary Examiner*—L. T. Hix
*Assistant Examiner*—Alan Mathews
*Attorney, Agent, or Firm*—Charles Hieken

[57] ABSTRACT

A film holder receives film chips for developing and enters through an input opening where a transport mechanism carries it into a developer tray having a thermistor for providing a signal representative of the developer temperature. This signal is used to control the development time to be inversely proportional to temperature. At the end of the development cycle the transport mechanism lifts the film holder from the developer tank, carries it to the fixing tank and deposits it in the fixing tank. At the end of the next development cycle, the transport mechanism lifts the film holder from the fixing tank, transports it to the wash tank and deposits it in the wash tank. At the end of the next development cycle, the transport mechanism lifts the film holder from the wash tank and deposits it in the drying chamber where forced hot air dries the developed fixed washed film chips. They may be removed through an exit door.

10 Claims, 5 Drawing Figures

BATCH DEVELOPING

BACKGROUND OF THE INVENTION

The present invention relates in general to developing and more particularly concerns novel apparatus and techniques for automatically batch developing film chips, such as dental X-rays, relatively rapidly, affording the correct developing time with apparatus that is compact, relatively free from complexity, operates reliably, is relatively easy and inexpensive to manufacture and may be used by relatively unskilled personnel.

It is an important object of the invention to provide improved methods and means for automatic batch developing.

It is a further object of the invention to achieve the preceding object with structure that is relatively compact, operates reliably and is relatively inexpensive to manufacture and operate.

It is a further object of the invention to achieve one or more of the preceding objects with apparatus that requires relatively little maintenance.

It is a further object of the invention to achieve one or more of the preceding objects while providing correct development time without maintaining critical control over developer temperature.

SUMMARY OF THE INVENTION

According to the invention, there is means for controlling the developing cycle to be inversely proportional to the developer temperature. To this end there is a developing tank, and temperature sensing means for sensing the temperature of the developer in the developing tank for providing a temperature signal, a fixing tank, and means for transferring film to be developed from the developing tank to the fixing tank to establish a developing time interval in response to the temperature signal inversely proportional to the developer temperature. There is means for transporting film from the fixing bath to a washing bath, and means for transporting film from the washing bath to a drying area.

A feature of the invention resides in the means for transporting film from one processing area to another. There are a plurality of endless belts each mounted upon spaced wheels. A support arm is pivotally attached at spaced points to corresponding ones of said endless belts, and motive power means are coupled to said first and second belts for moving said belts around the wheels to cause the support bar to translate in a direction along and generally perpendicular to the direction in which the processing tanks are spaced so that the support arm may lower and raise films into adjacent processing tanks and translate them from one tank to the other. Preferably, there are two pairs of endless belts preferably comprising chain links, the wheels are spur gears in respective corners of a rectangle with adjacent columns of gears spanning a distance along the direction along which the processing tanks are spaced corresponding substantially to the distance between the centers of adjacent processing tanks along this direction.

Still another feature of the invention resides in means for fastening trays with the shutoff wash input and the plug for connection to the thermistor.

Numerous other features, objects and advantages of the invention will become apparent from the following specification when read in connection with the accompanying drawing in which:

DETAILED DESCRIPTION OF PREFERRED EMBODIMENTS

Figure 1:
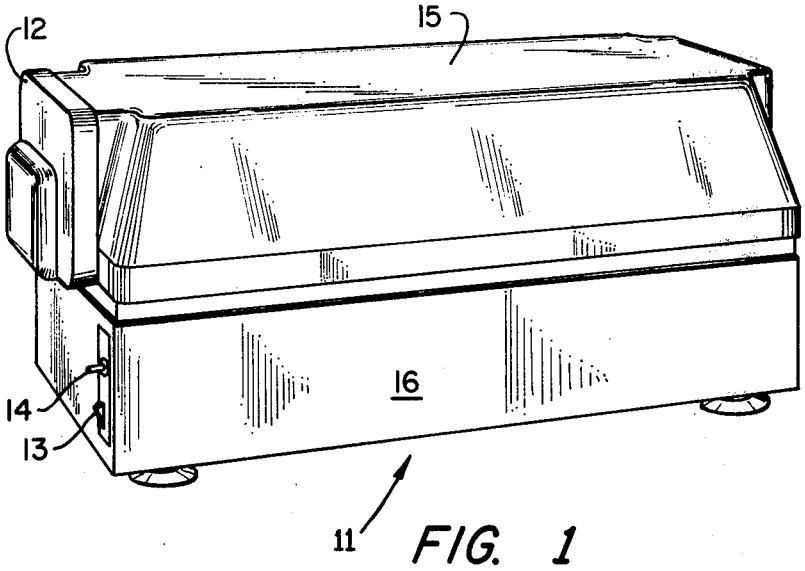
FIG. 1 is a perspective view of an embodiment of the invention.

Referring to FIG. 1, there is shown a perspective view of an embodiment of the invention showing batch developer 11 having an input door 12 hinged at the bottom for receiving film chips to be developed and an exit door at the right (not shown in FIG. 1) providing access to developed chips. A power switch 13 controls the delivery of electrical power to the system. Actuating switch 14 commences a development cycle. Front door 12 is part of cover 15 which is easily removable from base 16.

Figure 2:
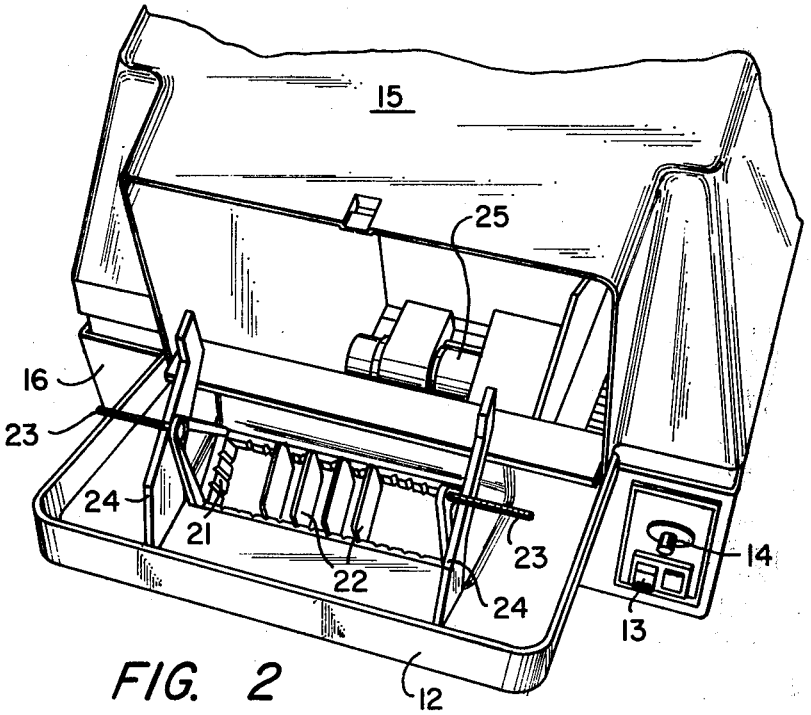
FIG. 2 is a perspective view with the input door down and a film chip holder in position ready to enter the film processing chamber when the door is raised.

Referring to FIG. 2, there is shown a perspective view of the input end of the batch developing unit with input door 12 down showing film chip holder 21 carrying film chips such as 22 suspended from end rods 23 which rest on input guide rails 24 formed so that when door 12 rises to the upright position shown in FIG. 1, film chip holder 21 is lifted by the mechanism powered by drive motor 25.

Figure 3:
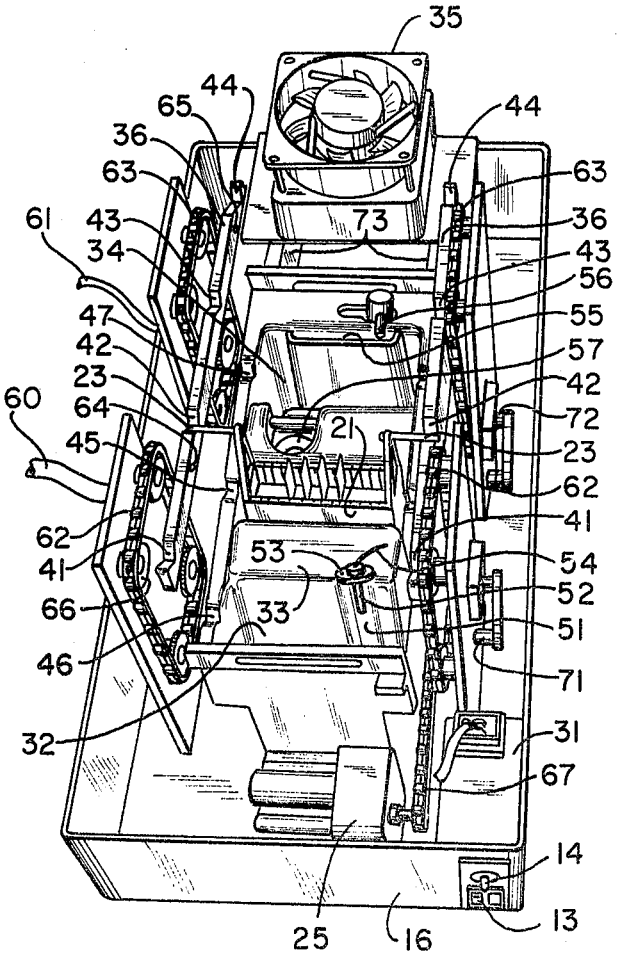
FIG. 3 is a perspective view of the embodiment of FIG. 1 with the cover removed and the film chip carrier entering the fixing tank.

Referring to FIG. 3, there is shown a perspective view of the batch processing unit according to the invention with cover 12 removed. Drive motor 25 is beside and controlled by control unit 31. The processing unit includes a developing tank 32, a fixing tank 33 and a washing tank 34 in that order from the entrance above motor 25 to the exit where blower motor 35 is supported above a heating unit (not shown) above the drying chamber at the exit end of the processing unit.

Transport bars 36 are each formed with V-shaped grooves 41, 42, 43 and 44 for accommodating support rods 23 of film carrier 21 shown seated in grooves 42 as carrier 21 is lowered into similar V-shaped grooves 45 embracing the center line of fixing tank 33. There are similar V-shaped grooves 46 and 47 embracing the center lines of developing tank 32 and wash tank 34, respectively.

Developing tank 32 is formed with a recess 51 for accommodating thermistor 52 seated in thermistor holder 53 to provide a temperature signal on output line 54 representative of the developer temperature in developing tank 32 to control unit 31 for controlling the time between operating cycles of drive motor 25 and, hence, the development time inversely proportional to developer temperature.

Wash tank 34 is formed with a channel 55 at the exit wall through which wash water from wash input 56 is guided to the bottom of the tank. Wash tank 34 is also formed with a recess near the top for accommodating drain 57 adjacent to the entrance wall. A plastic hose 61 may be connected to a faucet for carrying wash water to input 56, and a drain hose 62 is connected to drain 57 for carrying out the used wash water.

The means for supporting transport arms 44 comprises a first endless belt 62 near the entrance end and a second endless belt 63 near the exit end with each arm 44 pivotally attached to belts 62 and 63, such as at pivot points 64 and 65, respectively. Each of the endless belts comprises a link-chain that rides over four gear wheels, such as 66 and are driven in synchronism by an associated drive gear attached to first and second drive shafts near the entrance and exit ends, respectively, driven by drive belt 67 and not visible in FIG. 2. The drive shafts are seated below the tank assembly journaled in bearings such as 71 and 72 near the entrance and exit ends respectively.

Having described the structural arrangement, the mode of operation will be described. When motor 25 drives belts 62 and 63, the pivot points 64 and 65 of arms 44 describe a path corresponding substantially to that of endless belts 62 and 63 from a start position with the pivot point at minimum height and nearest to entrance door 12. At the start point grooves 41 are positioned to receive end rods 23 when door 12 is closed. Pushing start button 14 energizes motor 25 and causes transport arms 44 to move first up and then horizontally toward the exit end to a vertical plane embraced by V-shaped grooves 46 in developing tank 32 and then downward to a stop point with transport arms 44 below the top of the tanks and rods 23 then seated in grooves 46, thereby allowing the carrier film chips 22 to develop for a time interval determined by the developer temperature sensed by thermistor 52. Control unit 31 includes a delay unit that delays the energization of motor 25 for a time interval determined by the temperature signal provided on line 54 from thermistor 52. At this time arms 44 move horizontally toward entrance door 12 and then upward so that this time grooves 42 in transport arm 44 engage support rods 23 of film carrier 21, lift it out of developing tank 32, carry it horizontally toward fixing tank 33 and then downward into fixing tank 33 where it remains until the end of the next development cycle. Then grooves 43 carry film chip carrier 21 to wash tank 34 where it remains until the end of the next development cycle. Then grooves 44 carry it to the drying chamber and deposit rods 23 on sloping rails 73 at the entrance of the drying chamber.

Figure 4:
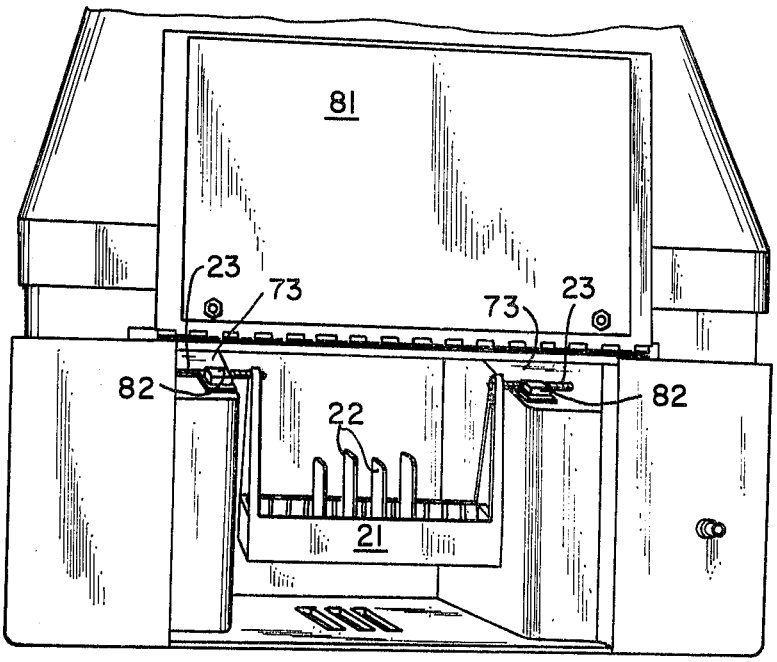
FIG. 4 is a perspective view of the output end of the embodiment of the invention showing developed chips in the drying chamber ready for removal.

Referring to FIG. 4, there is shown a perspective view of the exit end of the processing end of the processing unit with exit door 81 open showing rods 23 in contact with stops 82 at the lower end of rails 73. The drying compartment is large enough to accommodate a number of carriers 21 so that once an operator inserts a number of carriers into the input end, the operator may perform other duties and return later at a convenient time to lift exit door 81 and remove the dry developed film chips.

Figure 5:
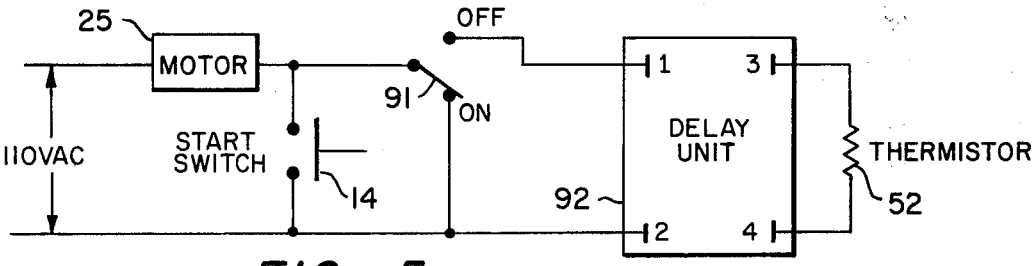
FIG. 5 is a combined schematic circuit-block diagram illustrating the logical arrangement of the means for controlling the development cycle to be inversely proportional to development temperature.

Referring to FIG. 5, there is shown a combined block-schematic circuit diagram illustrating the logical arrangement of a system according to the invention. Pressing start switch 14 energizes motor 25 and allows it to drive the endless belts through a complete cycle that is repeated at intervals determined by delay unit 92 related to the resistance of thermistor 52 which is inversely proportional to the temperature of the developer. An acceptable delay unit is the commercially available MMS 115A 5Y120A solid state time delay, and an acceptable thermistor is the commercially available Keystone Carbon Company KCC probe 101 RL 0504-530.5K-148GX, two being placed in series reasonably approximating desired resistance values of 2.877 megohms at 65° F., 2.242 megohms at 70° F., 1,8383 megohms at 75° F. and 1.4848 megohms at 80° F. for Solutek dental type developer to establish desired developing times of approximately 115, 90, 74 and 60 seconds, respectively within 15%.

The invention takes advantage of the times for fixing and washing and drying being not critical and controlling the developer cycle to be inversely proportional to developer temperature as contrasted with a more conventional approach of controlling developer temperature and using a fixed time interval for development.

The invention is especially useful in connection with developing dental X-rays. The specific embodiment described herein is by way of example for illustrating the best mode now contemplated for practicing the invention in connection with developing dental X-rays. Numerous variations from the specific structure and techniques may be practiced. For example, different transport mechanisms may be used, different timing mechanisms, different temperature sensing techniques, different belts and numerous other variations without departing from the inventive concepts.

It is evident that those skilled in the art may now make numerous other modifications and uses of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Batch developing apparatus comprising, developing tank means for holding a developing solution for developing film, temperature sensing means for sensing the temperature of developer in said developing tank means and for providing a representative temperature signal, means responsive to said temperature signal for controlling the developing time to be inversely proportional to the temperature of the developer in said developing tank means, transport means for inserting into and removing from said developing tank means film to be developed, and means responsive to said temperature signal for controlling said transport means and thereby control said developing interval.

2. Developing apparatus in accordance with claim 1 and further comprising, fixing tank means adjacent to said developing tank means for carrying fixer for fixing film developed in said developing tank means, said transporting means including means for transporting film from said developing tank means to said fixer tank means and inserting the film into and withdrawing the film from said fixer tank means for establishing the time between insertion of film in said developing tank means to insertion of the film into said fixing tank means to be inversely proportional to the developer temperature.

3. Developing apparatus in accordance with claim 2 and further comprising, wash tank means adjacent to said fixer tank means for washing film after being fixed in said fixing tank means, said transport means including means for transporting film from said fixing tank means to said wash tank means and inserting the film into and withdrawing the film from said wash tank means.

4. Developing apparatus in accordance with claim 3 and further comprising, drying means adjacent to said wash tank means for drying film after being washed in said wash tank means, said transport means including means for transporting the film from said wash tank means to said drying means.

5. Developing apparatus in accordance with claim 1 wherein said transport means comprises, a plurality of endless belts each mounted upon spaced wheels, a support arm pivotally attached at spaced points to corresponding ones of said endless belts, and motive power means coupled to said first and second belts for moving said belts around the wheels to cause the support bar to translate in a direction along and generally perpendicular to the length of said apparatus.

6. Developing apparatus in accordance with claim 5 wherein there are two pairs of said endless belts comprising chain links, said wheels are spur gears in respective corners of a rectangle with adjacent columns of gears spanning a predetermined distance along the direction of said apparatus.

7. Developing apparatus in accordance with claim 6 and further comprising, fixing tank means adjacent to said developing tank means for carrying fixer for fixing film developed in said developing tank means, said predetermined distance corresponding substantially to the distance between the centers of said developing tank means and said fixing tank means.

8. Developing apparatus in accordance with claim 7 and further comprising, wash tank means adjacent to said fixer tank means for washing film after being fixed in said fixing tank means, said predetermined distance also corresponding substantially to the distance between the centers of said fixing tank means and said wash tank means.

9. Developing apparatus in accordance with claim 8 and further comprising, drying means adjacent to said wash tank means for drying film after being washed in said wash tank means, said drying means being in a chamber having rails sloping downward from said wash tank means for receiving film transported by said transporting means from said wash tank means, said support arms being formed with opposed pairs of notches for receiving a film carrier with adjacent pairs of said notches being spaced substantially by said predetermined distance, each of said tank means being formed with opposed pairs of notches substantially embracing the centerline of a respective tank means.

10. Developing apparatus in accordance with claim 9 and further comprising, an input door at the entrance of said developing apparatus hinged at the bottom and formed with a pair of rails for receiving a film carrier whereby raising said entrance door causes said film carrier to slide down into the pair of opposed notches in said support arms nearest said entrance door when said entrance door is raised.

* * * * *